US007567033B2

(12) United States Patent
Oh et al.

(10) Patent No.: US 7,567,033 B2
(45) Date of Patent: Jul. 28, 2009

(54) BARRIER RIB STRUCTURE OF PLASMA DISPLAY PANEL AND LOWER PLATE STRUCTURE USING THE SAME

(75) Inventors: Sang Jin Oh, Osan-si (KR); Joon Kyu Park, Osan-si (KR); Dug Hwan Kim, Pyeongtaek-si (KR); Soon Kook Hong, Seongnam-si (KR); Kang Ug Lee, Suwon-si (KR); Hye Jin Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 395 days.

(21) Appl. No.: 11/324,256

(22) Filed: Jan. 4, 2006

(65) Prior Publication Data

US 2006/0170348 A1 Aug. 3, 2006

(30) Foreign Application Priority Data

Jan. 10, 2005 (KR) ..... 10-2005-0002194

(51) Int. Cl.
*H01J 17/49* (2006.01)

(52) U.S. Cl. ..... 313/582; 313/292

(58) Field of Classification Search ..... 313/582–587, 313/292; 445/23–25
See application file for complete search history.

(56) References Cited

U.S. PATENT DOCUMENTS 7,274,145 B2 * 9/2007 Chen et al. ..... 313/587

FOREIGN PATENT DOCUMENTS

CN 1327224 A 12/2001
JP 11-162347 A 6/1999

* cited by examiner

*Primary Examiner*—Joseph L Williams
(74) *Attorney, Agent, or Firm*—Birch, Stewart, Kolasch & Birch, LLP

(57) ABSTRACT

A barrier rib structure of a plasma display panel and a lower plate structure of the panel using the same, are discussed. According to an embodiment, the lower plate structure of the plasma display panel includes a substrate, barrier ribs formed on the substrate, and at least one blocking wall formed at least one beginning potion of the barrier ribs, from which a process of coating phosphor screens starts, to separate neighboring discharge spaces around the barrier ribs from each other.

14 Claims, 8 Drawing Sheets

BARRIER RIB STRUCTURE OF PLASMA DISPLAY PANEL AND LOWER PLATE STRUCTURE USING THE SAME

BACKGROUND OF THE INVENTION

1. Field of the Invention

The present invention relates to a plasma display panel. More particularly, the present invention relates to a barrier rib structure of a plasma display panel constructed to prevent colors of phosphor screens from being mixed, and a lower plate structure of the panel using the same.

2. Description of the Related Art

A general discharge display panel is a plasma display panel. The plasma display panel is a flat panel display in which scan and address electrodes are formed in a matrix shape between upper and lower plates to drive pixels, and an image is created using ultraviolet rays generated while generating electric discharge between the electrodes.

FIG. 1 shows the structure of a surface discharge type plasma display panel according to a related art. Referring to FIG. 1, an upper substrate of the plasma display panel includes a pair of bus electrodes 22 and 23 having certain width and height and formed on one side of a front glass substrate 21, a dielectric layer 24 for protecting the bus electrodes 22 and 23 and maintaining electric charges excited during a discharge to discharge the bus electrodes 22 and 23 with a low voltage during a sustain period, and a protection layer 25 on the dielectric layer 24 for preventing the bus electrodes 22 and 23 from being damaged due to strong discharge and for emitting secondary electrons.

Further, a lower substrate of the plasma display panel includes address electrodes 27 formed on one side of a rear glass substrate 26 to selectively select each unit cell and induce an initial discharge. A dielectric layer 33 for insulating the address electrodes 27 is formed on the address electrodes 27. An electric discharge space is formed on the dielectric layer 33, and barrier ribs 28 for separating the unit cells and preventing crosstalk between the adjacent cells are formed in the electric discharge space. Phosphor screens 30, 31 and 32 made of red (R), green (G) and blue (B) phosphors, which are excited by ultraviolet rays generated by the discharge operation to emit visible light, are coated on side surfaces of the barrier ribs 28 and an upper surface of the dielectric layer 33. The barrier ribs 28 are formed either in a stripe shape as illustrated in FIG. 2*a* or in a closed shape as illustrated in FIG. 2*b*.

Accordingly, the electric discharge spaces 29 are formed between the lower and upper substrates. Neon gas, xenon gas, helium gas and the like for electric discharge are injected into the electric discharge spaces 29. A lower surface of the upper substrate is brought into a close contact with an upper surface of the lower substrate of the display panel, and a resultant unit cell of the plasma display panel can be formed accordingly.

In the related art plasma display panel configured as discussed above, a surface discharge occurs to display an image on the display panel, as follows. If an initial discharge voltage is applied to the bus electrodes 22 and 23 and the address electrodes 27 such that the potential difference can be generated between these electrodes, an initial discharge is generated in the electric discharge spaces 29 and ultraviolet rays are then generated while the surface discharge is generated between the pair of the bus electrodes 22 and 23. At this time, the phosphors of the surrounding phosphor screens 30, 31 and 32 are excited by means of the ultraviolet rays and colors are simultaneously displayed.

That is, electrons existing in the electric discharge spaces 29 are accelerated by the applied voltage and collide with an inert mixed gas injected into the electric discharge spaces 29 at a pressure of about 400 to 600 torr to generate ultraviolet rays which in turn collide with the phosphor screens 30, 31 and 32 to generate the visible light. Accordingly, it is possible to display a desired image by combining the cells of the electric discharge spaces 29 in which the electric discharge occurs with the cells of the electric discharge spaces 29 in which the electric discharge does not occur.

However, the foregoing plasma display panel has the following limitations and problems.

In order to display an image on the related art plasma display panel, the phosphor screens 30, 31 and 32 respectively having different colors of red, green and blue are injected into the spaces between the adjacent barrier ribs 28. A screen printing process, an inkjet process, or a dispensing process according to a related art is used to inject the phosphor screens 30, 31 and 32 between the adjacent barrier ribs 28. In the dispensing process, the dispensing materials of the phosphor screens are discharged into the spaces between the respective barrier ribs through discharge holes formed on nozzles. At this time, the discharge hole should be formed such that its diameter is smaller than a gap between the adjacent barrier ribs 28. However, the related art dispensing process has a problem of mixed colors since the phosphor screen materials permeate through the neighboring barrier ribs 28. That is, the related art dispensing process for forming the phosphor screens 30, 31 and 32 has the following problems.

In a case where the barrier ribs 28 are formed in a stripe shape as illustrated in FIG. 2*a*, due to unstable control of the discharge pressure of the phosphor screen materials, an excessive discharge of the phosphor screen materials is partially generated on a portion where the phosphor screen materials start to be coated. Further, the excessive discharge of the phosphor screen materials allows the phosphor screen materials to permeate through the neighboring barrier ribs by means of a capillary phenomenon, because spaces between the discharge holes of the nozzles and the barrier ribs 28 are very small. This creates another problem wherein the colors of the phosphor screens 30, 31 and 32 between the adjacent discharge spaces 29 are mixed. This problem also occurs at a portion where the discharge of the phosphor screens 30, 31 and 3, as well as the portion where the discharge of the phosphor screens is started.

Furthermore, in a case where the barrier ribs 28*a* and 28*b* are formed in a closed shape as illustrated in FIG. 2*b*, the phosphor screens 30, 31 and 32 may be coated even on the lateral barrier ribs 28*b* when executing the continuous pattern coating. Therefore, there is another problem wherein the phosphor screens coated on the lateral barrier ribs 28*b* flow into neighboring discharge spaces 29 along the barrier ribs 28*b*, which results in the undesired mixing of colors of the phosphor screens.

SUMMARY OF THE INVENTION

Therefore, an object of the present invention is to provide a barrier rib structure of a plasma display panel in which the shape of barrier ribs is improved to prevent the mixing of colors of phosphor screens.

Another object of the present invention is to provide a lower plate structure of a plasma display panel in which the shape of barrier ribs is improved to prevent the mixing of colors of phosphor screens.

Another object of the present invention is to provide a plasma display panel and its barrier rib structure, which overcome the limitations and disadvantages associated with the related art.

According to an aspect of the present invention, there is provided a lower plate structure of a plasma display panel, comprising: a substrate; barrier ribs formed on the substrate; and at least one blocking wall formed at least one beginning portion of the barrier ribs, from which a process of coating phosphor screens starts, to separate neighboring discharge spaces around the barrier ribs from each other.

According to another aspect of the present invention, there is provided a lower plate structure of a plasma display panel, comprising: a substrate; barrier ribs formed on the substrate; and grooves each formed between adjacent barrier ribs and extending substantially perpendicularly to a coating direction of a coating solution for coating discharge spaces defined by the barrier ribs, whereby the coating solution is prevented from being transferred to the adjacent discharge spaces.

According to another aspect of the present invention, there is provided a barrier rib structure of a plasma display panel having closed type barrier ribs, comprising: grooves formed between upper surfaces of the closed type barrier ribs and extending substantially perpendicularly to a coating direction of a coating solution to be applied to discharge spaces of the closed type barrier ribs.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of a barrier rib structure of a plasma display panel and a lower plate structure using the same according to the present invention will be described in detail with reference to the accompanying drawings.

Figure 1:
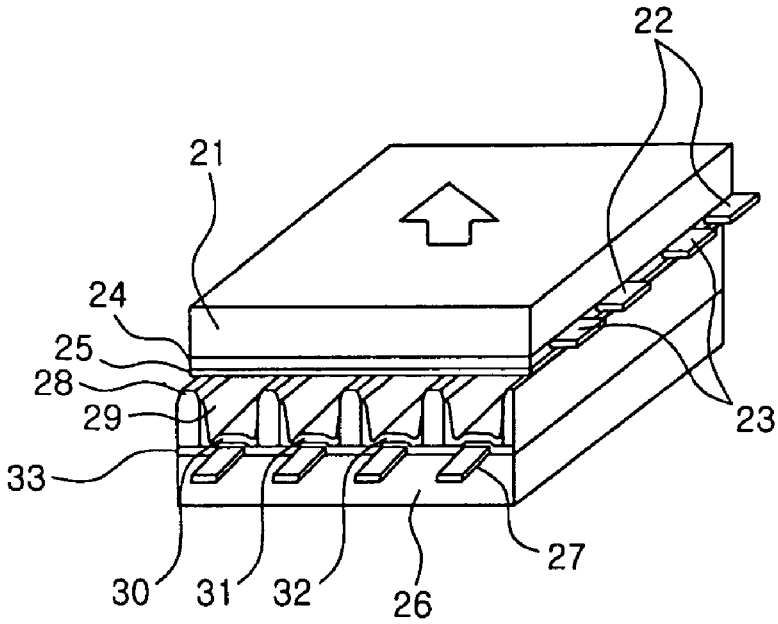
FIG. 1 Related Art
FIG. 1 is a structural view of a plasma display panel according to a related art.
Figure 2A:
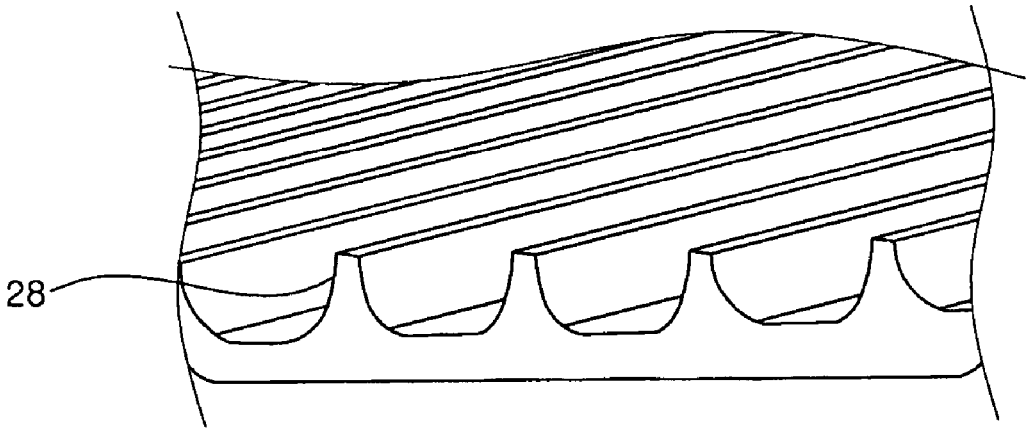
FIG. 2a Related Art
FIG. 2*a* is a structural view of one example of general stripe type barrier ribs.
Figure 2B:
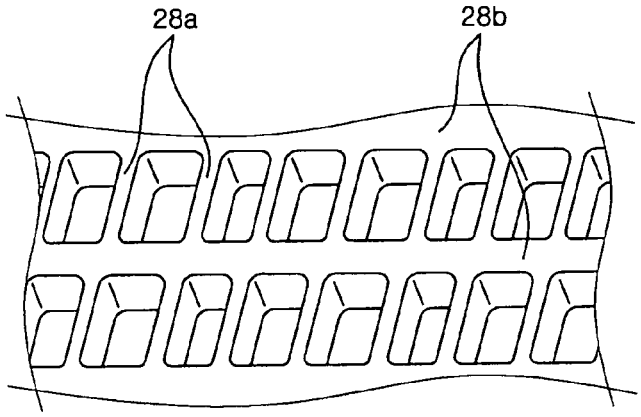
FIG. 2b Related Art
FIG. 2*b* is a structural view of another example of general closed type barrier ribs.
Figure 3:
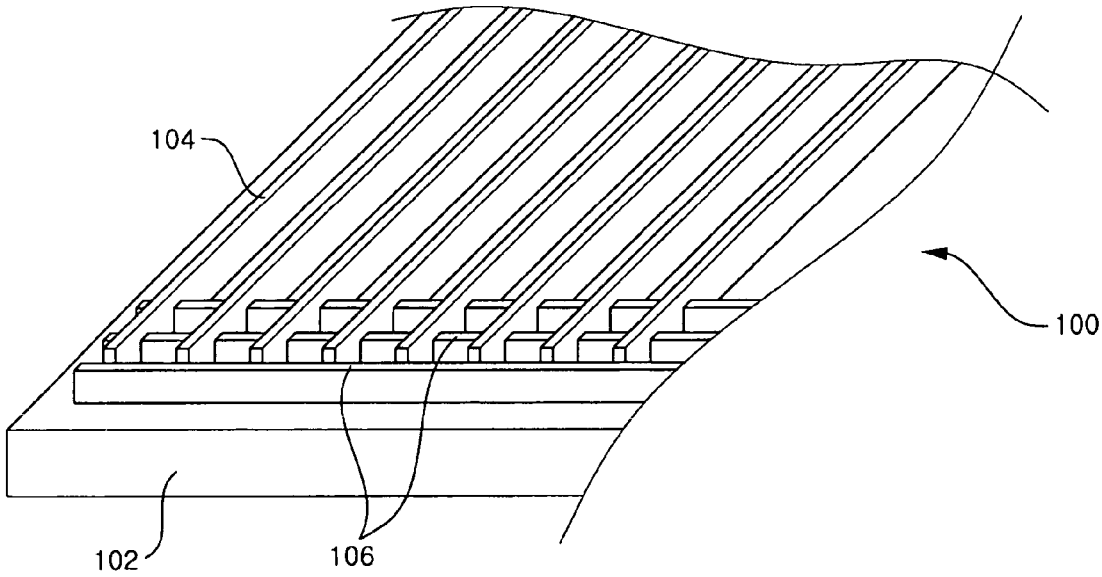
FIG. 3 is a partial perspective view showing a lower plate structure of a plasma display panel according to an embodiment of the present invention.
Figure 4:
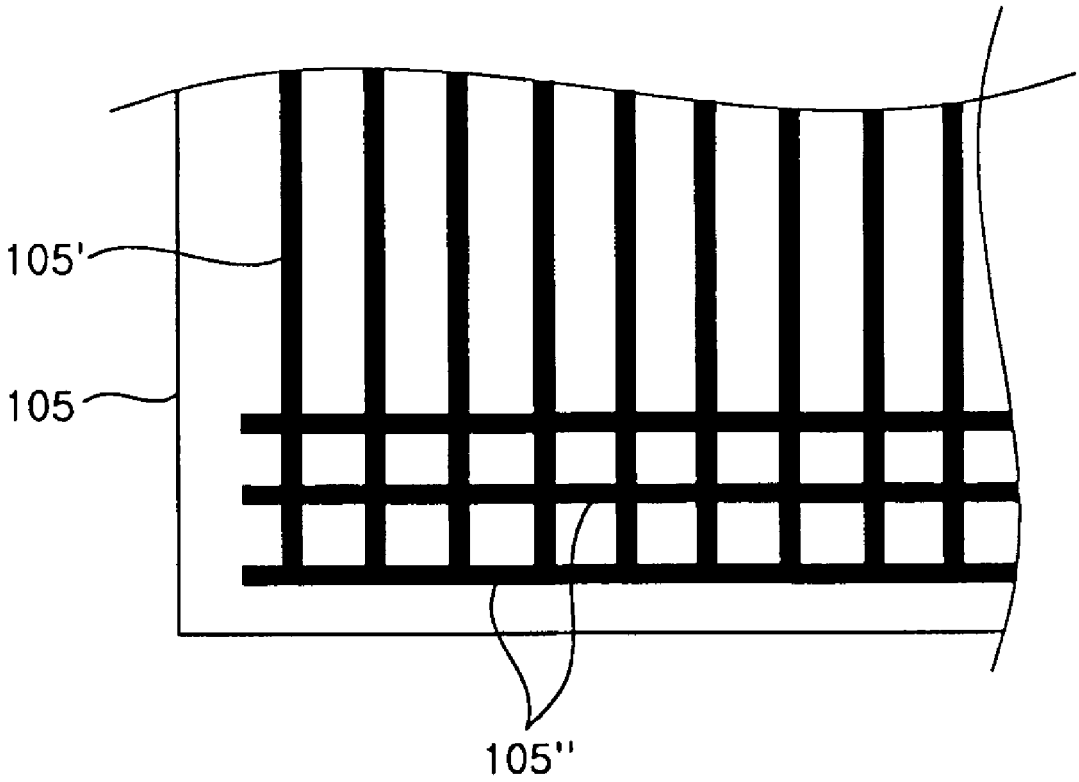
FIG. 4 is a plan view showing the construction of a mask for fabricating the barrier ribs and blocking walls of FIG. 3.
Figure 5:
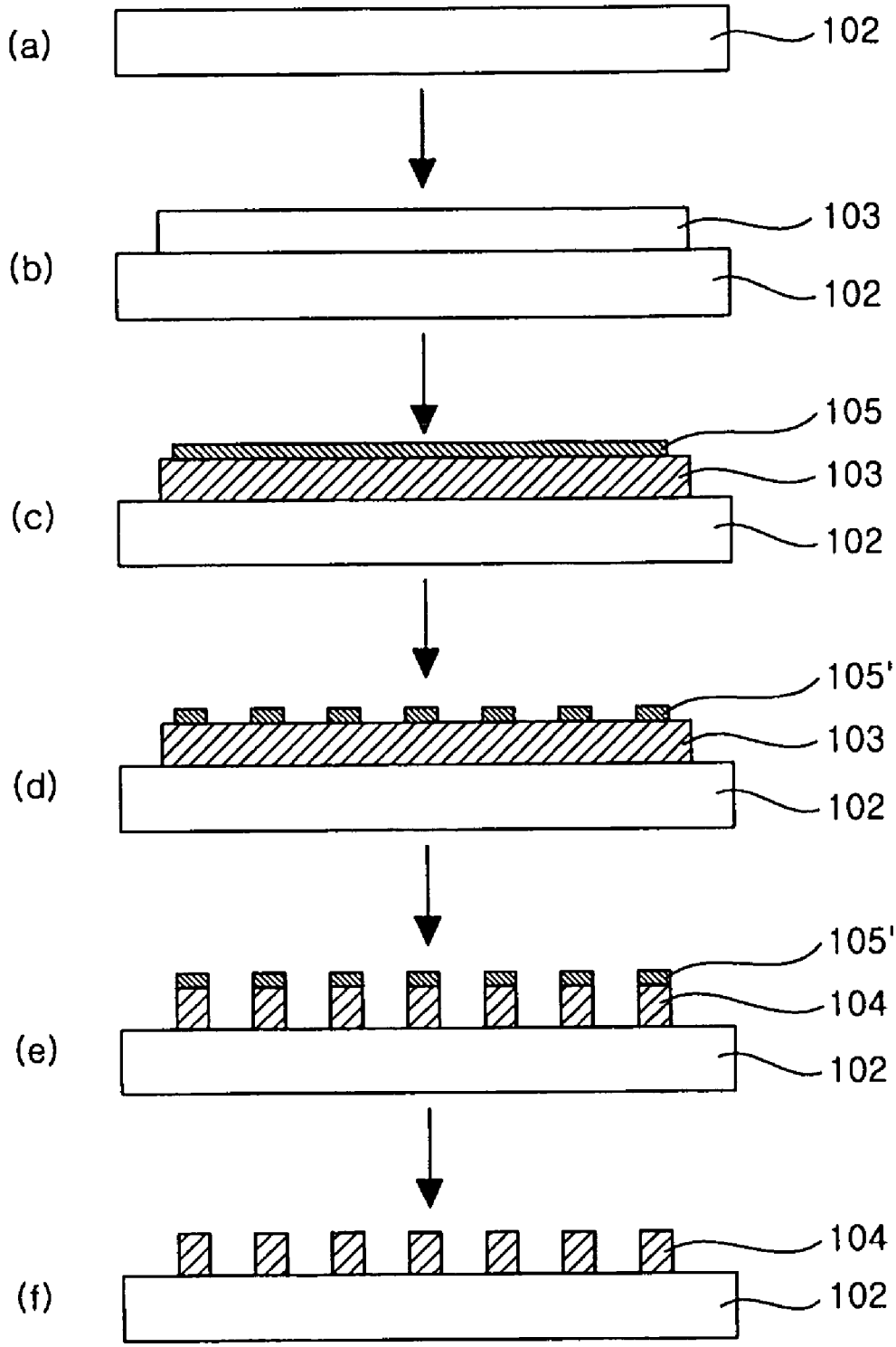
FIGS. 5(*a*) to 5(*f*) are workflow diagrams sequentially showing processes of fabricating the embodiment illustrated in FIG. 3.

FIG. 3 shows a perspective view of the configuration of a barrier rib structure of a plasma display panel according to an embodiment of the present invention, FIG. 4 shows a plan view of the construction of a mask for forming the barrier rib structure of FIG. 3, and FIG. 5 shows a workflow diagram sequentially illustrating processes of forming the barrier rib structure shown in FIG. 3.

Referring to FIGS. 3-5, barrier ribs 104 are formed in a stripe shape on a substrate 102 that constitutes a lower plate/substrate 100 of a plasma display panel. More specifically, a plurality of barrier ribs 104 with predetermined widths and heights are formed side by side at regular intervals. The plurality of barrier ribs 104, each of which extends in a straight line, are formed side by side.

A blocking wall 106 is formed on an end portion of one side of each of the barrier ribs 104. Here, the block walls 106 are formed only on one side of the barrier ribs 104, but if desired, they can be formed on both or other sides of the barrier ribs 104. In this example, the blocking walls 106 are formed on portions of the barrier ribs where phosphor screens start to be coated. When coating the phosphor screens by means of, e.g., a dispensing process, a coating solution for coating the phosphor screens starts to be discharged at the beginning portions of the barrier ribs 104 and a partial excessive discharge of the coating solution is then generated due to the inaccurate setting of discharge pressure of the coating solution. The blocking walls 106 are installed to prevent such excessively discharged coating solution from being transferred to spaces defined between the adjacent barrier ribs 104, i.e. discharge spaces. In other words, the blocking walls 106 serve to prevent the colors of phosphor screens from being mixed at the beginning portions of the barrier ribs 104.

In the embodiment shown in FIG. 3, the blocking walls 106 are formed on portions of the barrier ribs, such that they are not disposed beyond the end portions of the barrier ribs 104 and are not higher than the barrier ribs 104. In this embodiment, the barrier ribs 104 and the blocking walls 106 cross each other to form rectangularly divided spaces or substantially rectangular spaces. The outermost blocking wall 106 can be brought into contact with the ends of the barrier ribs 104. At least two blocking walls 106 are preferably formed to clearly prevent the coating solution from being transferred to the discharge spaces. That is, the blocking walls 106 includes a first blocking wall extending substantially perpendicular to the barrier ribs and abutting end surfaces of the barrier ribs at one side of the plasma display panel, and one or more second blocking walls extending substantially perpendicular to the barrier ribs and including a plurality of wall pieces disposed between adjacent barrier ribs at the one side of the plasma display panel, a shown in FIG. 3.

In the meantime, FIG. 4 shows a plan view of a mask 105 on which patterns 105' and 105" are formed to construct the barrier ribs 104 and the blocking walls 106 of FIG. 3. That is, a mask 105 in the beta state is selectively removed to form a mask in a state shown in FIG. 4. The mask 105 is formed of a photosensitive resin such as, for example, a dry film and can have a thickness of about 20 μm. The pattern 105" of the blocking wall can have a width of about 0.3 mm.

Next, a process of fabricating a lower plate having the barrier rib structure of the embodiment shown in FIG. 3 is explained with reference to FIG. 5 according to an embodiment of the present invention. FIG. 5 illustrates a process of forming the barrier ribs by using an etching process such as a chemical etching process.

Glass is generally used as a substrate 102 (FIG. 5(*a*)). The substrate 102 is cut to a desired size and the cut substrate is then rinsed to remove foreign substances from the substrate. A barrier rib material 103 is coated onto an upper surface of the substrate 102 to form barrier ribs thereon (FIG. 5(*b*)).

After the barrier rib material 103 has been coated on one surface of the substrate 102, a firing process of hardening the barrier rib material 103 by heating the barrier rib material 103 coated on the substrate 102 is performed. The barrier rib material 103 is then attached or fixed to the substrate 100 by the firing process. The hardened barrier rib material 103 is marked with slant lines in FIG. 5(*c*).

Then, a mask 105 in a beta state is placed on the hardened barrier rib material 103 (FIG. 5(*c*)). Further, the mask 105 is selectively removed such that only the barrier rib patterns 105' and the blocking wall patterns 105" are left (FIG. 5(*d*)). At this time, the mask 105 can be selectively removed by processes such as exposure to light, development and rinse.

The barrier rib material 103 protected by the barrier rib patterns 105' will become barrier ribs 104. The barrier rib patterns 105' are removed except for the portions on the barrier rib material 103 on which the barrier ribs 104 will be formed, and the blocking wall patterns 105" are removed except for the portions on the barrier rib material 103 on which the blocking walls 106 will be formed.

Thereafter, the barrier rib material 103 is selectively removed to form the barrier ribs 104 and blocking walls 106 (FIG. 5(*e*)). That is, the barrier ribs 104 and blocking walls 106 are formed by etching the barrier rib material 103 using the barrier rib patterns 105' and the blocking wall patterns 105" of the mask, such that the barrier rib material 103 on a portion on which the mask 105 is left is not removed and the barrier rib material 103 on a portion on which the mask 105 is not left is removed.

When a predetermined period of time to complete the etching process has passed after a certain amount of the etching solution has been injected through the aforementioned process, a rinsing process is performed. The etching process is repeatedly performed until the barrier ribs 104 having uniform thickness are obtained.

In a state of FIG. 5(*f*), the lower substrate 102 on which the barrier ribs 104 and blocking walls 106 are formed is completed by performing the processes of removing the barrier rib patterns 105', rinsing the substrate to remove the etching solution covered on the substrate 102 and drying the rinsed substrate.

Figure 6:
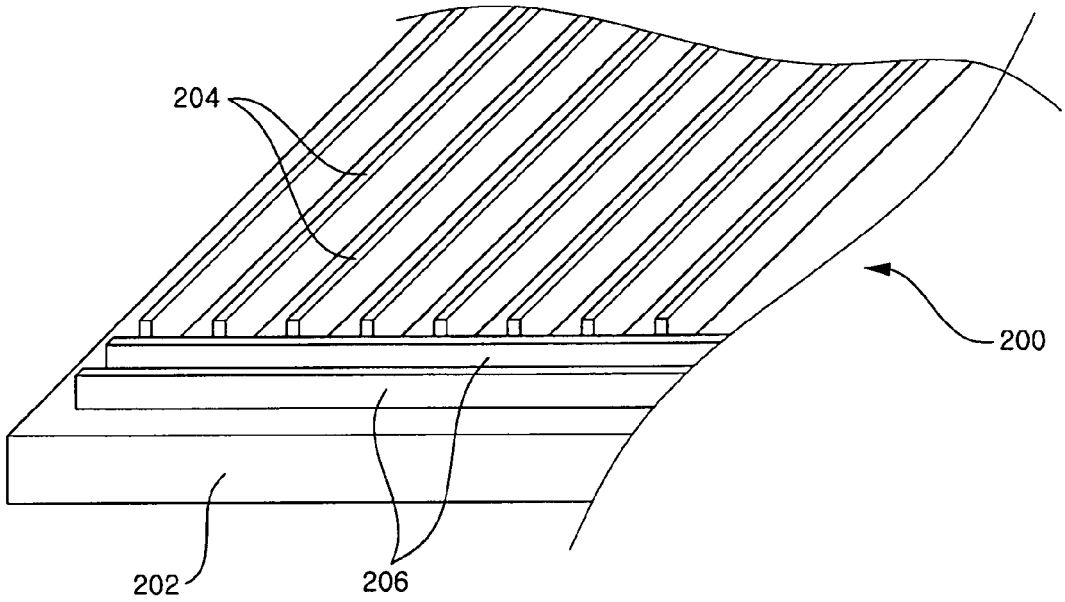
FIG. 6 is a partial perspective view showing another example of a lower plate structure of a plasma display panel according to an embodiment of the present invention.

FIG. 6 shows another example of a barrier rib structure of a plasma display panel according to an embodiment of the present invention. Only the major portions of this embodiment will be explained for the sake of convenience. In this figure, reference numerals expressed in two hundreds designate portions similar to those of the embodiment shown in FIG. 3.

As shown in FIG. 6, barrier ribs 204 are formed on a substrate 202 to form a lower plate/substrate 200 of a plasma display panel, and blocking walls 206 are formed thereon. The innermost blocking wall 206 is brought into contact with end portions of one side of the barrier ribs 204, and the other blocking walls 206 are formed on portions that are beyond the end portions of the barrier ribs 204. In this example, therefore, divided spaces defined by the blocking walls 206 crossing the barrier ribs 204 are not formed since the blocking walls 206 and the barrier ribs 204 do not cross each other. The blocking walls 206 can be also formed to be as high as or lower than the barrier ribs 204.

At least two blocking walls 206 are preferably formed to more effectively prevent a coating solution from flowing over the blocking walls into the adjacent discharge spaces.

Figure 7:
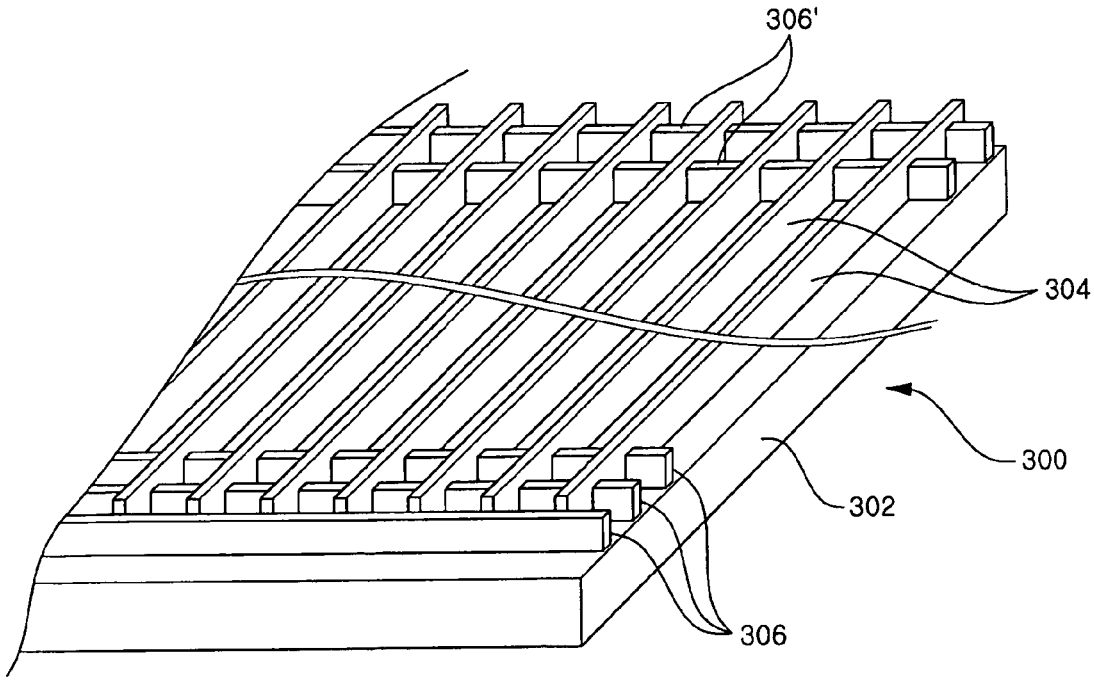
FIG. 7 is a partial perspective view showing another example of a lower plate structure of a plasma display panel according to an embodiment of the present invention.

FIG. 7 shows another example of a barrier rib structure of a plasma display panel according to an embodiment of the present invention. Likewise, only the major portions of this embodiment will be explained for the sake of convenience, and reference numerals expressed in three hundreds designate portions similar to those of the embodiment shown in FIG. 3.

As shown in FIG. 7, barrier ribs 304 are formed on a substrate 302 to form a lower plate/substrate 300 of a plasma display panel, and blocking walls 306 and 306' are formed thereon. The blocking walls 306 and 306' are formed respectively at positions corresponding to both ends of the barrier ribs 304. The blocking walls 306 and 306' can be also formed to be as high as or lower than the barrier ribs 304. With such construction, the blocking walls 306 formed at the beginning portions of the barrier ribs 304 and the blocking walls 306' formed at the finishing portions of the barrier ribs 304 prevent a coating solution from being transferred to spaces defined between the adjacent barrier ribs 304 when discharging the coating solution by means of the dispensing process. That is, the blocking walls 306 and 306' prevent the movement of the coating solution between the barrier ribs 304, which may be generated in the coating beginning and finishing portions due to a change in the discharge pressure of the coating solution and limitation in the discharge of the coating solution into very small spaces between the discharge holes and the barrier ribs 304. It is also preferred in this embodiment that at least two blocking walls 306 and 306' be formed.

Figure 8:
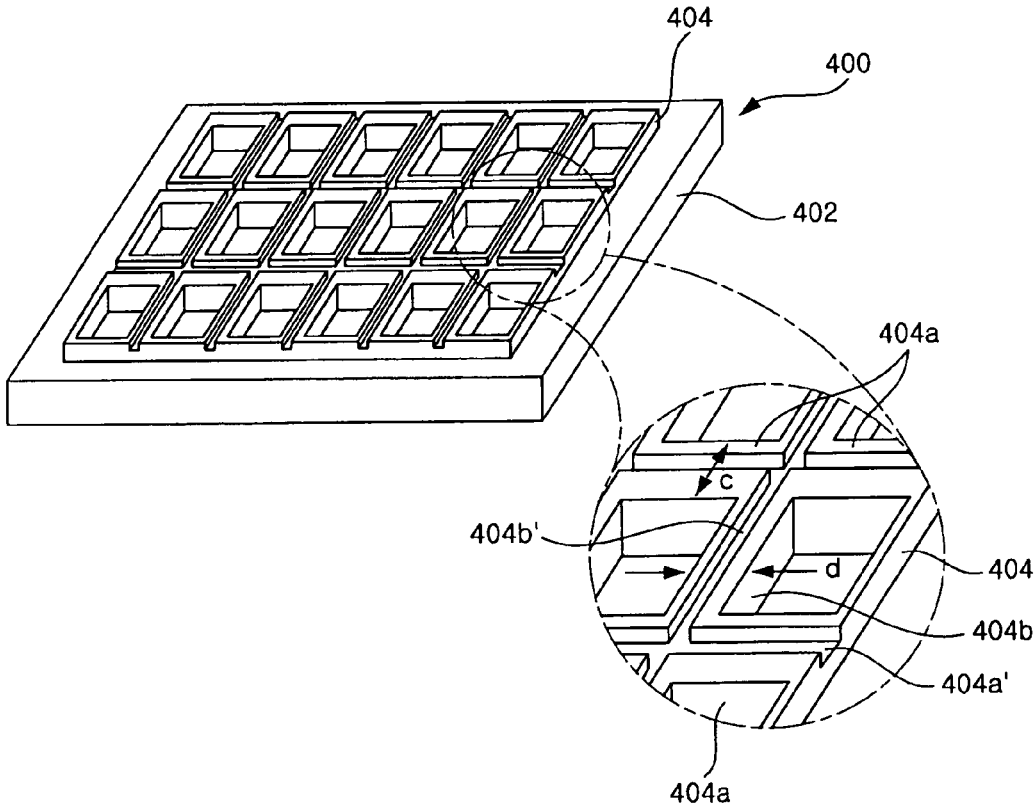
FIG. 8 is a perspective view showing another example of a lower plate structure of a plasma display panel according to an embodiment of the present invention.
Figure 9:
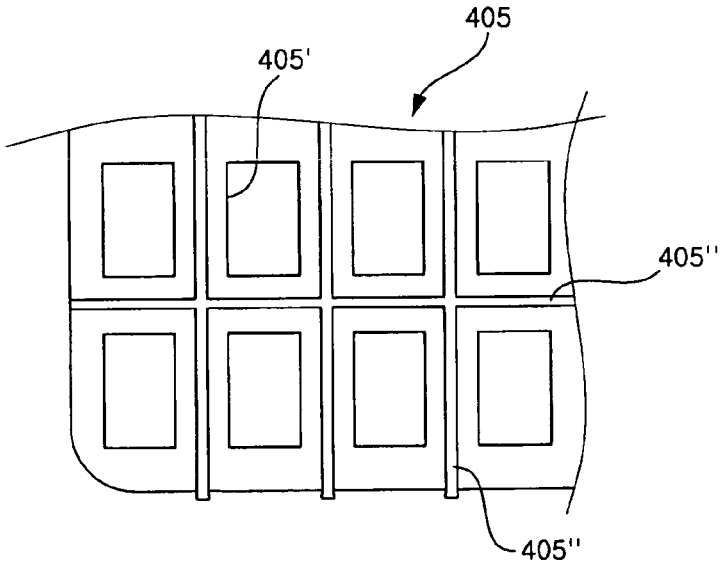
FIG. 9 is a plan view showing the construction of a mask for fabricating the barrier ribs and blocking walls of FIG. 8.

Next, FIGS. 8 and 9 show another embodiment of the present invention. In this embodiment, the present invention is applied to closed type barrier ribs.

As shown in FIGS. 8 and 9, closed type barrier ribs 404 are formed on a substrate 402 that constitutes a lower plate/substrate 400 of a plasma display panel. The barrier ribs 404 include first barrier rib portions 404*a* and second barrier rib portions 404*b* which in turn cross perpendicularly each other to form discharge spaces in which phosphor screens are coated.

Grooves 404*a'* are formed between upper surfaces of the first barrier rib portions 404*a* of the barrier ribs 404 extending perpendicularly to a direction in which the coating solution is coated, so that the coating solution is not transferred to the adjacent discharge spaces. Other grooves 404*b'* are also formed between upper surfaces of the second barrier rib portions 404*b* extending parallel to a direction in which the coating solution is coated; however, the grooves 404*b'* may not be need. That is, it is acceptable and sufficient that the grooves 404*a'* are formed in a longitudinal direction of the first barrier rib portions 404*a* between the upper surfaces of the first barrier rib portions 404*a* on which the coating solution is actually coated.

Of course, the grooves 404*b'* are also longitudinally formed between the upper surfaces of the second barrier rib portions 404*b*. However, the grooves 404*b'* are not spaces for allowing the coating solution coated directly on the first barrier rib portions 404*a* to be moved away, but the grooves 404*b'* serve to prevent the coating solution, which has been transferred from the discharge spaces onto the upper surfaces of the second barrier rib portions 404*b* in the process of coating the coating solution in the discharge spaces, from being transferred again to the adjacent discharge spaces.

According to an embodiment, a mask 405 as shown in FIG. 9 is used to form the barrier ribs 404 with the aforementioned grooves 404*a*' and 404*b*' formed therein. Barrier rib patterns 405' and groove patterns 405" are selectively formed on the mask 405. The barrier rib patterns 405' are used to form the barrier ribs 404, and the groove patterns 405" are used to form the grooves 404*a*' and 404*b*'. The groove patterns 405" may be constructed, for example, such that they can transmit light well, compared with the barrier rib patterns 405'.

A dry film can be used as the mask 405 and the mask 405 can have a thickness of about 20 μm. In order to form the grooves 404*a*'and 404*b*', a dry film having ⅓ or less width of the upper portions of the barrier ribs can be used in a semi-transparent or non-protection pattern section.

The grooves 404*a*' and 404*b*' are formed in such a manner that the portions of the grooves corresponding to about 5 to 70% of the upper width of the barrier ribs 404 are about 5 to 70% lower than the barrier ribs 404. Furthermore, the barrier ribs 404 are formed in such a manner that a ratio of the crosswise upper width of the barrier ribs (arrow 'd' in FIG. 8) to the lengthwise upper width of the barrier ribs (arrow 'c' in FIG. 8) is about 200% or less.

Next, a method for fabricating the barrier ribs on the plasma display panel according to the embodiment of FIGS. 8 and 9 will be described with reference to FIG. 10. Here, the barrier ribs 404 are formed using a sand blast process corresponding to a physical etching process, but other process(es) can be used.

A substrate 402 with the barrier ribs 404 formed thereon is processed/rinsed and then cut to a certain size. At this time, the barrier rib material 403 made of a material such as aluminum can be deposited on the upper surface of the substrate 402. The barrier rib material 403 is formed in a beta shape.

Figure 10:
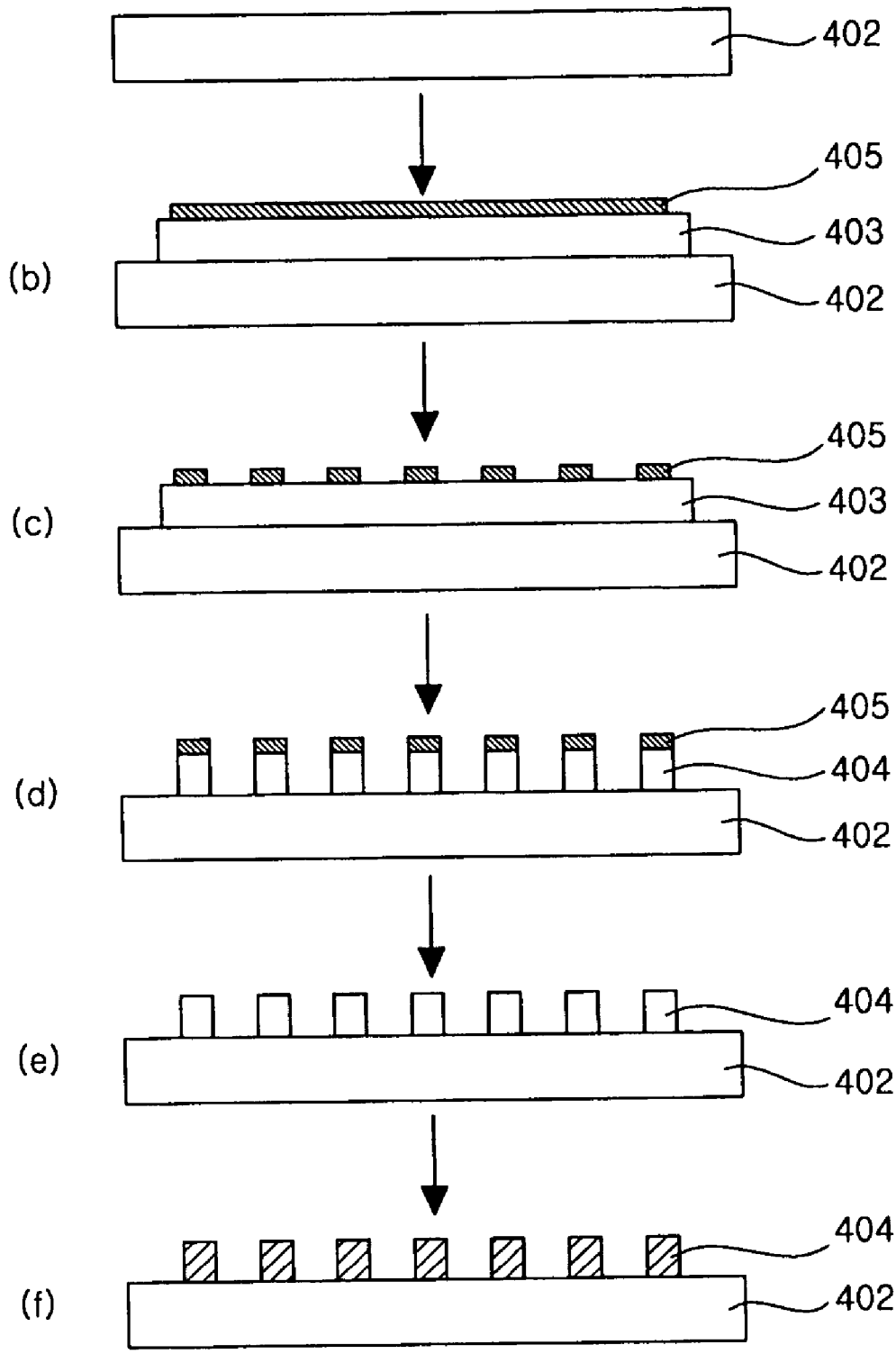
FIGS. 10(*a*) to 10(*f*) are workflow diagrams sequentially showing processes of fabricating the embodiment illustrated in FIG. 8.

More specifically, as shown in FIGS. 10(*a*) and 10(*b*), if a barrier rib material 403 is formed on the upper surface of the substrate 402, the barrier rib patterning is performed. The barrier rib patterning is conducted by placing the mask 405 made of a photosensitive resin onto the barrier rib material 403 and then allowing the barrier rib patterns 405' to be formed, through the exposure to light, development and rinse, on portions of the barrier rib material where the barrier ribs 404 should be formed as shown in FIG. 10(*c*). Further, the other portions of the barrier rib material 403 are exposed, and thus, a patterning process of discriminating the portions to be patterned from the portions to be etched can be performed.

Then, a sand blast process can be performed on the barrier rib material 403 in a state where the barrier rib patterns 405' of the mask 405 are left on the barrier rib material 403, whereby the barrier rib material 403 is etched such that only the barrier ribs 404 are left as shown in FIG. 10(*d*).

When the physical etching process has been finished, the barrier rib material 403 between the barrier ribs 404 is etched and removed as shown in FIG. 10(*d*). The mask 405 attached onto the barrier ribs 404 is removed (FIG. 10(*e*)), a firing process of heat treating the barrier ribs 404 at a high temperature is performed, and a process of forming the barrier ribs 404 is then completed (FIG. 10(*f*)).

Figure 11:
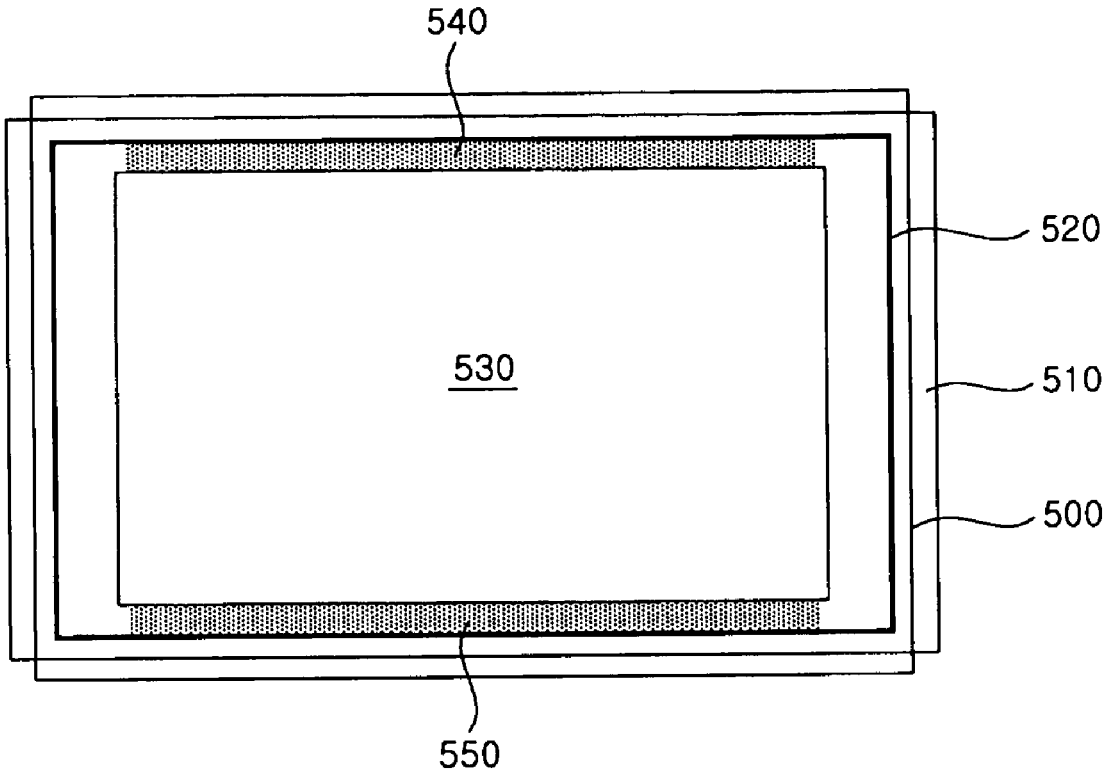
FIG. 11 is a structural view of a plasma display panel to which the constitution of the present invention is applied.

FIG. 11 shows a plan view of a plasma display panel having the barrier rib structure according to an embodiment of the present invention. As shown in FIG. 11, in the plasma display panel, a lower plate 500 with the barrier ribs and blocking walls formed thereon is bonded to an upper plate 510 in a state where they are sealed by means of a sealing portion 520. Here, the barrier ribs and blocking walls can be any one of the examples of the barrier ribs and blocking walls discussed above. For instance, the blocking walls 540 and 550 are positioned between a display region 530 and the sealing portion 520 that seals the upper plate 510 and the lower plate 500.

The plasma display panel according to the present invention as described above can provide the following effects and advantages.

The shape of the barrier ribs can be changed to suppress or prevent the occurrence of the mixing of colors of the phosphor screens generated while coating the phosphor screens. For example, the blocking walls are formed at the beginning and/or finishing portions of the barrier ribs to prevent the coating solution from being transferred from a discharge space to the adjacent discharge spaces defined between the barrier ribs. Therefore, there is an advantage in that the mixing of colors of the phosphor screens is not generated.

In addition, the grooves can be formed between the upper surfaces of the barrier ribs to suppress the occurrence of the mixing of colors of the phosphor screens generated while coating the phosphor screens. The grooves can be formed between the upper surfaces of the barrier ribs formed perpendicularly to a direction in which the phosphor screens are coated, particularly in closed type barrier ribs. Therefore, since the grooves prevent the coating solution, which is coated on the upper surface of the barrier ribs in the closed type barrier ribs when continuously coating the barrier ribs with a coating solution for forming phosphor screens, from being transferred to adjacent discharge spaces, the mixing of colors of the phosphor screens is not generated and effectively prevented.

Although the present invention has been illustrated and described in connection with the preferred embodiments and the accompanying drawings, it is not to be limited thereto. Therefore, it will be readily understood by those skilled in the art that various modifications and changes can be made thereto without departing from the spirit and scope of the present invention defined by the appended claims. Accordingly, the scope of the present invention should be construed to be defined only by the appended claims.

What is claimed is:

1. A lower plate structure of a plasma display panel, comprising:

a substrate;

barrier ribs formed on the substrate; and a plurality of blocking walls formed at least one beginning portion of the barrier ribs, from which a process of coating phosphor screens starts, so as to separate neighboring discharge spaces around the barrier ribs from each other, wherein the plurality of blocking walls include:

a first blocking wall extending substantially perpendicular to the barrier ribs and abutting end surfaces of the barrier ribs at one side of the plasma display panel; and at least one second blocking wall extending substantially perpendicular to the barrier ribs and including a plurality of wall pieces disposed between adjacent barrier ribs at the one side of the plasma display panel.

2. The lower plate structure as claimed in claim 1, further comprising:

at least one blocking wall formed at least one finishing portion of the barrier ribs at which the process of coating the phosphor screens is finished.

3. The lower plate structure as claimed in claim 1, wherein the at least one blocking wall is disposed between a display region and a sealing portion of the plasma display panel.

4. The lower plate structure as claimed in claim 1, wherein the at least one blocking wall is as high as or lower than the barrier ribs.

5. The lower plate structure as claimed in claim 1, wherein the barrier ribs are formed in a stripe shape.

6. The lower plate structure as claimed in claim 1, further comprising:

at least one third blocking wall formed at least one finishing portion of the barrier ribs, and extending substantially perpendicular to the barrier ribs, the at least one third blocking wall including a plurality of wall pieces disposed between adjacent barrier ribs at another side of the plasma display panel.

7. A lower plate structure of a plasma display panel, comprising:

a substrate;

barrier ribs formed on the substrate; and a plurality of blocking walls formed at least one beginning portion of the barrier ribs, from which a process of coating phosphor screens starts, so as to separate neighboring discharge spaces around the barrier ribs from each other, wherein the plurality of blocking walls include:

a first blocking wall extending substantially perpendicular to the barrier ribs and abutting end surfaces of the barrier ribs at one side of the plasma display panel; and a second blocking wall disposed substantially parallel to the first blocking wall and not contacting the barrier ribs.

8. A lower plate structure of a plasma display panel, comprising:

a substrate;

barrier ribs formed on the substrate; and grooves each formed between adjacent barrier ribs and extending substantially perpendicularly, the grooves parallel to a coating direction of a solution coating discharge spaces defined by the barrier ribs, whereby the coating solution is prevented from being transferred to the adjacent discharge spaces, wherein the grooves are formed concavely between adjacent discharge spaces.

9. The lower plate structure as claimed in claim 8, wherein the barrier ribs are formed in a closed shape.

10. The lower plate structure as claimed in claim 9, wherein the closed shape is a rectangular shape.

11. The lower plate structure as claimed in claim 8, wherein portions of the barrier ribs corresponding to 5 to 70% of an upper width of the barrier ribs are about 5% to 70% lower than the barrier ribs.

12. A barrier rib structure of a plasma display panel having closed type barrier ribs, comprising:

first grooves formed between upper surfaces of the closed type barrier ribs and extending substantially perpendicularly to a coating direction of a coating solution applied to discharge spaces of the closed type barrier ribs; and second grooves formed between upper surfaces of the closed type barrier ribs and extending in a direction substantially parallel to the coating direction of the coating solution, wherein the first and second grooves are depressed on the upper surfaces of the closed type barrier ribs between adjacent discharge spaces.

13. The barrier rib structure as claimed in claim 12, wherein the barrier ribs are in a rectangular shape and arranged in a matrix configuration.

14. The barrier rib structure as claimed in claim 12, wherein a ratio of a crosswise upper width of the barrier ribs to a lengthwise upper width of the barrier ribs is about 2 or less.

* * * * *